US008648298B2

(12) United States Patent
Franzen

(10) Patent No.: US 8,648,298 B2
(45) Date of Patent: Feb. 11, 2014

(54) EXCITATION OF IONS IN ICR MASS SPECTROMETERS

(75) Inventor: Jochen Franzen, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 240 days.

(21) Appl. No.: 12/633,421

(22) Filed: Dec. 8, 2009

(65) Prior Publication Data

US 2010/0176289 A1 Jul. 15, 2010

(30) Foreign Application Priority Data

Dec. 30, 2008 (DE) ..... 10 2008 064 610

(51) Int. Cl.
*H01J 49/00* (2006.01)

(52) U.S. Cl.
USPC ..... 250/293; 250/281; 250/282; 250/290

(58) Field of Classification Search
USPC ..... 250/281, 282, 290, 291, 292, 293, 250/396 R, 396 ML, 397
See application file for complete search history.

(56) References Cited

U.S. PATENT DOCUMENTS 4,686,365 A 8/1987 Meek et al.
4,761,545 A * 8/1988 Marshall et al. ..... 250/291
4,874,943 A 10/1989 Spencer
5,436,447 A 7/1995 Shew
2008/0302958 A1* 12/2008 Green ..... 250/282

FOREIGN PATENT DOCUMENTS

GB 2 263 191 7/1993
GB 2 428 515 1/2007

OTHER PUBLICATIONS

Pitsakis et al., Ion Cyclotron Resonance Bridge Detector for Frequency Sweep, Rev. Sci. Instrum. 54(11), Nov. 1983, pp. 1476-1481.

* cited by examiner

*Primary Examiner* — Robert Kim
*Assistant Examiner* — Hanway Chang
(74) *Attorney, Agent, or Firm* — Robic, LLP

(57) ABSTRACT

In an ion cyclotron resonance mass spectrometer ions are excited into cyclotron orbits by an alternating current excitation signal having a nonlinear function of the excitation frequency vs. time in a "chirp." Such an excitation signal produces transients which have no pronounced beats, even if mixtures of many ion species, all having the same mass differences, are present. The dynamic measuring range for the image currents can thus be better utilized. In particular, sum spectra of specified quality can be generated from a significantly smaller number of individual transients, and thus in a significantly shorter measuring time.

12 Claims, 5 Drawing Sheets

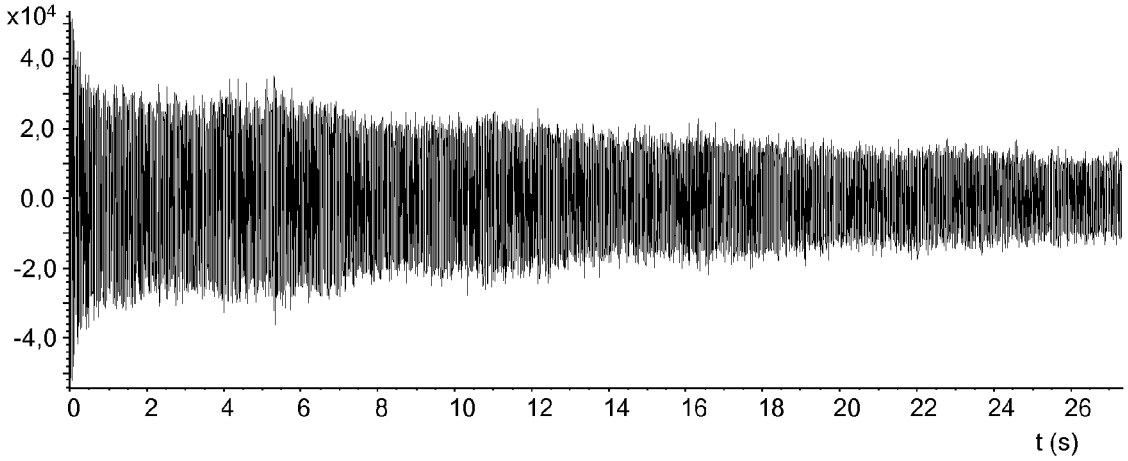
*FIG. 3 (Prior Art)*
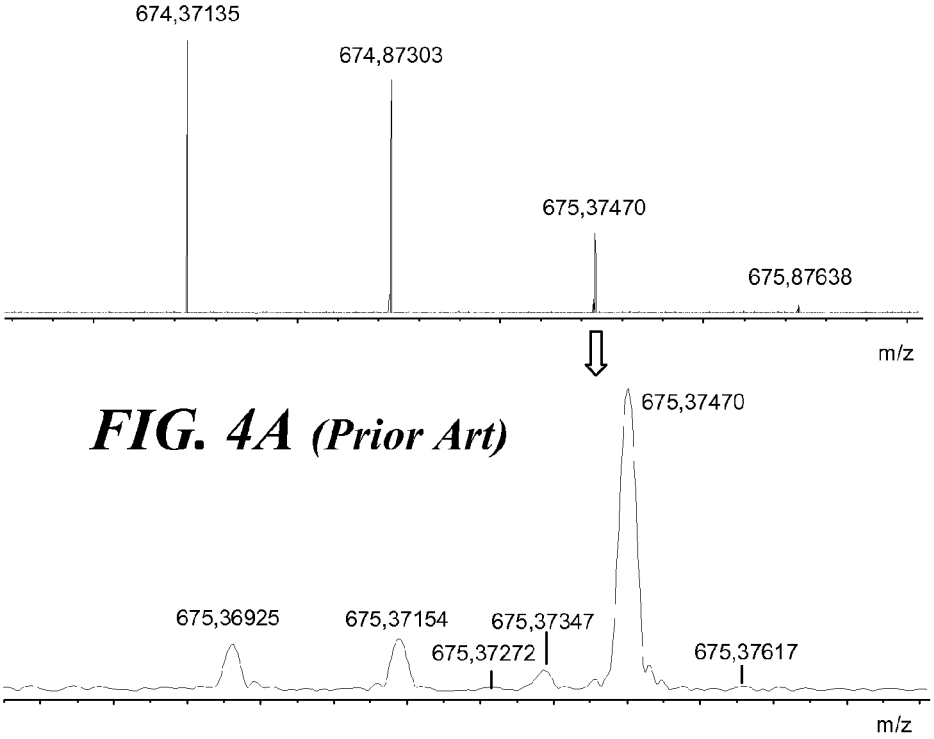
*FIG. 4A (Prior Art)*
*FIG. 4b (Prior Art)*

EXCITATION OF IONS IN ICR MASS SPECTROMETERS

BACKGROUND

The invention relates to methods for the acquisition of mass spectra in ion cyclotron resonance mass spectrometers, in particular to methods for exciting the ions to cyclotron trajectories. In ion cyclotron resonance mass spectrometers (ICR-MS), the charge-related masses m/z of the ions are determined by measuring their orbital frequencies in a homogeneous magnetic field with high field strength. The orbital motion is essentially a cyclotron motion on which a smaller magnetron motion is usually superimposed. The magnetic field is normally generated by superconducting magnet coils cooled with liquid helium. Nowadays, commercial mass spectrometers provide ICR measuring cells with usable diameters of up to approximately 6 centimeters at magnetic field strengths of between 7 and 15 tesla.

In ICR measuring cells, the orbital frequency of the ions is measured in the most homogeneous part of the magnetic field. The ICR cells normally comprise four longitudinal electrodes, which are parallel to the magnetic field lines and surround the interior of the measuring cell like a cylinder jacket. Cylindrical measuring cells are usually used, as shown in FIG. 1. The ions are introduced close to the axis. Normally, two opposing longitudinal electrodes, the "excitation electrodes", are used to excite ions to their cyclotron motion by means of a pulse with alternating electric fields. Ions with the same charge-related mass m/z have to be excited as coherently as possible in order to achieve an in-phase orbiting cloud of these ions. The excitation to cyclotron motion brings the ions into circular orbits, whose diameter is usually around two thirds of the interior diameter of the ICR measuring cell. The two other electrodes, the "measuring electrodes", serve to measure the orbiting of the ion clouds by image currents induced in the measuring electrodes as the ion clouds fly past.

The introduction of the ions into the measuring cell, ion excitation and ion detection are carried out in successive phases of the method. Various methods are available to introduce the ions into the ICR measuring cell and, in particular, for their capture, for example the "side-kick" method or the method of dynamic capture with a steady increase of the potential, but they will not be discussed further here. Those skilled in the art are familiar with these methods.

The ions are excited by absorbing energy in a dipolar alternating electric field between the two excitation electrodes. The frequency of the field must resonantly coincide with the cyclotron frequency of an ion species. The cyclotron frequency of the ions is inversely proportional to their mass m/z. Since the ratio m/z of the mass m to the number of elementary charges z of the ions (referred to below simply as "charge-related mass", and sometimes simply as "mass") is unknown before the measurement, the ions are excited by as homogeneous a mixture as possible of all the excitation frequencies for a desired mass range. This mixture can be a temporal mixture with frequencies linearly increasing or decreasing with time (called a "chirp"), or it can be a synchronous, computer-calculated mixture of all frequencies (a "sync pulse"). Commercial mass spectrometers usually operate with chirps; their initial and final frequencies, duration and voltage are chosen so that they lift ions of a selected mass range uniformly to a cyclotron trajectory with desired radius.

The ion image currents that are induced in the detection electrodes by the orbiting ion clouds form a co-called "transient" as a function of time. The transient is a "time-domain signal". It usually starts with initially large ion image currents, which decrease during the measuring time to such a degree that only noise remains. The useful length of the transient up to the informationless noise is usually a few seconds, but in correctly adjusted ICR cells with compensation electrodes, as shown in FIG. 2, for example, it can last up to a few tens of seconds.

The ion image currents of the transients are amplified, digitized and analyzed by Fourier analysis to determine the orbital frequencies of the ion clouds occurring therein; the ion clouds each consist of ions of different masses orbiting in phase. The Fourier analysis transforms the sequence of the original ion image current values of the transient from the "time domain" into a sequence of frequency values in a "frequency domain". ICR is therefore also called Fourier Transform Mass Spectrometry (FTMS), although it should be noted that, today, there are other types of FTMS which are not based on the orbiting of ions in magnetic fields.

The frequency signals of the various ion species, which can be recognized as peaks in the frequency domain, are then used to determine their charge-related masses m/z and their intensities. The high stability of the magnetic fields used and the high accuracy for frequency measurements make it possible to achieve an extraordinarily accurate mass determination. Fourier transform ICR mass spectrometers (FT-ICR-MS) are currently the most accurate of all types of mass spectrometer, with accuracies far better than one millionth of the mass for masses in the range up to around one thousand atomic mass units. FT-ICR-MS also provides the best mass resolutions, which are usually above one million for lighter ions, but which decline in inverse proportion as the mass of the ions increases. The mass resolution essentially depends on the number of ion orbits which can be detected by the measurement.

The transient usually looks like a very noisy signal which decreases roughly exponentially in time. The noise is only apparent; the signal very reproducibly consists of the superimposition of the many ion image current frequencies. FIG. 3 shows an example of a particularly long transient of the ion image currents of the doubly charged ions of "substance P", which represents the typical shape of such a transient. The mass spectrum of the isotope group of these ions can be derived from this transient by Fourier transformation and further conversions, as is shown in FIGS. 4*a* and 4*b*. FIG. 4*a* shows the complete mass spectrum, which consists of the monoisotopic ions, the first $^{13}C$ satellite and the second $^{13}C$ satellite, and has a mass resolution of R=2,500,000. FIG. 4*b* shows the fine structure of the second $^{13}C$ satellite in greatly enlarged detail; it is only observable with such a high mass resolution. Such measurements are useful in many ways; they can be used to quickly and easily determine the elementary composition of the substance under investigation, for example.

If, however, a particular mixture of ions consists of a larger number of ion species whose masses differ by the same mass difference in each case, the ion image current transient looks completely different. When the ions are excited by a standard chirp, so-called "beats" are formed in the transient when the image currents are measured. The ion clouds jointly lifted onto the cyclotron trajectory are initially all close together and produce the strong image currents of a first beat. The ion clouds of the slightly different masses, having slightly different speeds, then increasingly separate, however, and spread almost uniformly over the whole orbit over a long period; their image current signals appear to almost cancel each other out, as happens with an interference. Only when the ion clouds come close together again after many orbits is there a next "beat" of the image current. This process repeats periodically. The number of orbits $n_b$ between two beats is $n_b=M/\Delta M$, where M is the mass of the first ion of the group and $\Delta M$ is the mass difference between the different ions of the mixture.

These beats are especially common if one investigates organic substances with very high molecular weights. The ions of these substances are usually produced by electrospraying, which creates a broad distribution of multiply charged ions for large molecules. As an example, FIG. 5 shows a broadband mass spectrum of BSA (bovine serum albumin, molecular mass M=66,432.455 58 u). The signals of the protonated molecular ions with 32 to 63 charges can be seen. For substances with very high mass in the order of several ten thousands of atomic mass units, commonly at first a broadband overview spectrum is acquired, and then a narrowband mass spectrum showing only the ions of one charge state at maximum resolution. These mass spectra with very high mass resolution are analytically very useful; they can be used to identify not only the elemental composition, but also derivatization states, the purity of the substance and associations with smaller molecules.

With heavy organic substances, the ions of one charge state form an isotope group with often far more than a hundred isotope satellites. Since the ions of this isotope group each differ by one atomic mass unit (to be more precise, by the mass difference between $^{12}C$ and $^{13}C$ in each case), they constitute a very uniformly structured ion mixture, which forms a transient with pronounced beats on being excited with a chirp, as can be seen in FIG. 6 for the protonated molecular ions of BSA with 49 charges.

The information contained in the transients is not only found in the beats, but also in the spaces between the beats, which visually appear to be almost empty. In these spaces, the image current frequencies are superimposed in a similar way to the "normal" transient of FIG. 3. In order to measure the image current values in the spaces efficiently, the dynamic measurement range must be extraordinarily large. The usually already high dynamic measurement range of 20 bits in commercial ICR electronics is not sufficient for this. Special measures are required to obtain the full information that is contained in the measured values of such a transient with strong beat. The special measures usually consist in acquiring the image current transient not only once, but many hundreds of times.

The mass spectrum of the isotope signals of the BSA ions with 49 charges, which is shown in FIGS. 7*a*, 7*b* and 7*c* in three magnifications, could only be measured well, and even with a mass resolution of R=800,000, because the transients of 200 image current measurements have been summed. Since each transient had a length of 15 seconds, the complete measuring time here was 3,000 seconds or 50 minutes. Such a long measuring time is not acceptable for many analytical tasks. Moreover, a successful summation of 200 individual spectra demands not only a stable magnetic field, but also an extraordinarily high stability of all the electrical parameters in the electronics, which is rarely the case.

As stated above, the beats are produced by an interference behavior of the ions during their orbits. The excitation lifts the ions to a cyclotron trajectory where all the ion clouds are initially very close together and result in a strong ion image current signal, the first beat. Then the ion clouds, which each differ by a tiny fraction of their relative mass and thus by a tiny fraction of their speed, slowly drift apart and distribute themselves almost evenly over the complete cyclotron orbit. When the distribution is even, however, the ion image current signals almost cancel each other out; the intensity of the signals is very low and can hardly be measured next to the intense beats. In the case of BSA, all the ions then come together again after 66,389 orbits of the monoisotopic ions; the ions of the first $^{13}C$ satellite mass pass through one orbit less than the monoisotopic ions, the ions of the second satellite two fewer orbits, the ions of the third satellite three fewer orbits, etc. This produces the second beat. The ion species then spread out again until they meet up once again after a further 66,389 orbits to form a third beat.

This process continues periodically but the beats become smaller and smaller because, although the mass differences are identical over the whole mixture, this is not the case for the differences of the speeds, which are reciprocal to the masses, as can easily be mathematically verified. Since the differences in the speeds are only equal in the first approximation, albeit a very good approximation, the ions meet up less and less after each successive 66,389 orbits, and their beat becomes smaller.

The chirps used in the current prior art have a linear frequency function with the same amplitude for all frequencies, as is shown in FIG. 8. In commercial ICR mass spectrometers, the initial frequency, final frequency, duration and amplitude (voltage) of the chirp are usually adjustable. The frequency range is from a few kilohertz up to around 100 kilohertz; the voltage can be set between a few volts and around 300 volts; the duration of the chirp can be up to 20 milliseconds or more.

To describe the effect of a chirp, we will now assume it to be a chirp with linearly increasing frequency. For this chirp with linearly increasing frequency function, the ions are excited in a sequence from heavy to light masses. If the increasing frequencies of such a linear chirp cover the cyclotron resonance frequencies of all the ions of an ion mixture in roughly ten milliseconds, the lightest ions reach their cyclotron orbit some ten milliseconds later than the heaviest ions. The temporal separations of the ions for reaching the orbit are proportional to their mass difference.

If the ion mixture consists of ions with the same mass differences throughout, all ions catch up with the heaviest ions simultaneously because the light ions fly slightly faster on their orbit and because the temporal separations between the lighter ions and the heavier ones are inversely proportional to their speed on reaching the orbit. All the light and heavy ions will therefore come together at the same time, resulting in the first beat.

The image currents are measured using amplifiers which offer a wide range of amplification adjustment, and analog-to-digital converters (ADC) with 16 to 20 bit conversion width. The latter determine the dynamic measuring range with which a transient can be measured.

Where the term "acquisition of an ICR mass spectrum" or similar wording is used below, this encompasses the complete sequence of steps: filling the ICR measuring cell with ions, exciting the ions to cyclotron trajectories, measuring the image current transient, digitizing, Fourier transformation, determining the frequencies of the individual ion species and, finally, calculating the charge-related masses m/z and intensities of the ion species which constitute the mass spectrum, as is known by anyone skilled in the art.

SUMMARY

In accordance with the principles of the invention ions in an ICR measuring cell are excited by a chirp with a nonlinear frequency function to, at least, strongly reduce, if not completely prevent, the generation of beats. When a nonlinear function of the frequency vs. time is used in the chirp, once the ions have each reached their orbit, the orbital separations between the ions are no longer proportional to their speeds. It is therefore no longer possible for all the ions to meet at the same point in time. The more distant the ions are from each other at the closest convergence, the more effectively the generation of a beat is prevented.

Any continuous and, preferably, also continuously differentiable nonlinear function can be selected as the frequency function. It is advantageous, for example, to select a quadratic dependence of the frequency on time, or a root function.

For a nonlinear frequency function with constant amplitude of the excitation voltage, the ions of different mass are excited for slightly different durations and thus lifted to cyclotron trajectories of slightly different radii; it is therefore advantageous to change the amplitude with the frequency function in such a way that the ions are lifted to the same cyclotron trajectories. FIG. 9 is a diagrammatic representation of a frequency function (F) and a compensating amplitude function (V). The amplitudes here are assumed to be proportional to the gradient of the frequency function, i.e., proportional to the first derivative of the frequency as a function of time.

BRIEF DESCRIPTION OF THE DRAWINGS

FIG. 3 shows the typical appearance of a transient without beats. It shows an image current transient, 26 seconds in length, which was measured for the acquisition of a narrowband mass spectrum of the doubly charged molecular ions of substance P (molecular formula $C_{63}H_{100}N_{18}O_{13}S$).

FIG. 4*a* shows the corresponding narrowband mass spectrum, which was measured with a resolution of R=2,500,000. The monoisotopic signal of the doubly charged molecular ions and three $^{13}C$ satellites are visible in the mass spectrum. FIG. 4*b* is an enlargement of a part of FIG. 4*a* and shows the fine structure of the second $^{13}C$ satellite; the high resolution providing a well-resolved structure.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

The invention consists in using nonlinear chirps to excite the ions in an ICR measuring cell. The term "nonlinear chirp" here means a chirp with nonlinear frequency function. The nonlinear frequency function for the excitation can, at least, greatly reduce, and usually even completely prevent, the generation of beats.

Figure 9:
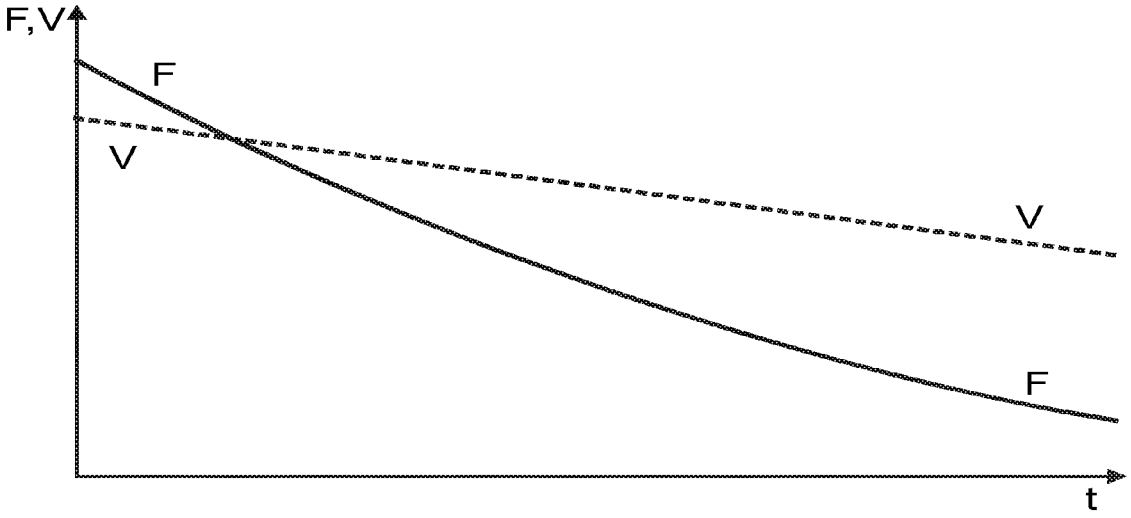
FIG. 9 shows a chirp according to this invention with a nonlinear frequency function (F) and a compensating amplitude function (V).

Chirps can be used with increasing or decreasing frequency function. Any continuous and, preferably, also continuously differentiable nonlinear function can be selected for the nonlinear frequency function. It is advantageous, for example, to select a quadratic dependence of the frequency on time, or a root function. But higher power functions, an exponential function or logarithmic function can also be used. FIG. 9 illustrates a decreasing frequency function with quadratic dependence on time.

With a nonlinear frequency function in the chirp, the time differences and also the separations of the ions on reaching the orbit are nonlinearly stretched. The separations of the ion clouds are no longer proportional to their speeds, which are determined by the cyclotron frequencies of their ions and do not change. Since the starting points of the ions in the orbit are stretched in a nonlinear way, the ions can no longer meet up at a single point in time. The further the ions are from each other at a closest convergence, the more effectively the generation of a beat is prevented.

A nonlinear frequency function with constant amplitude of the excitation voltage no longer excites the different ion species of different masses in the same way. Since the speed of change of the frequencies is no longer constant, some ion species are excited for a slightly longer time than others, because their resonant frequency is supplied for a somewhat longer time. The varying length of excitation causes different ion species to be lifted to cyclotron trajectories of slightly different radii. The change in speed corresponds to the gradient of the frequency function or the first derivative of the frequency as a function of time.

In order to lift all the ions to the same orbit, the amplitude must be changed with the frequency. It is advantageous to change the amplitude proportionally to the gradient of the frequency function. FIG. 9 shows a diagrammatic representation of a frequency function (F) and a compensating amplitude function (V). For a frequency function which changes with the square of the time, a linear function of the amplitude is produced for an advantageous compensation of the excitation.

Figure 1:
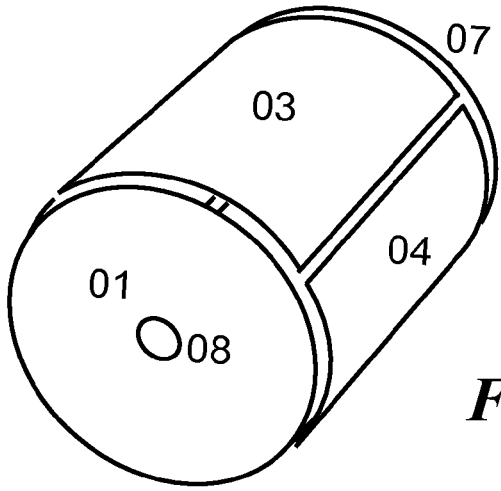
FIG. 1 (Prior Art)
FIG. 1 shows a cylindrical ICR measuring cell according to the prior art. Between the two trapping electrodes (01) and (07), which here take the form of apertured diaphragms, are four longitudinal electrodes (02-05) in the shape of cylinder jacket segments, although only two longitudinal electrodes (03, 04) are visible. Of the four longitudinal electrodes, two opposed electrodes, for example (03) and (05), serve to excite the ions to cyclotron trajectories and the other two serve to measure the ion image currents.

The excitation of the ions in the ICR measuring cell is effected by two excitation electrodes (or two series of excitation electrodes) which are located opposite each other, and to which the voltages of the chirp are applied. This generates a somewhat distorted dipole field. The distortion has proven to be almost completely irrelevant. FIG. 1 shows a simple ICR measuring cell with its four longitudinal electrodes.

Figure 2:
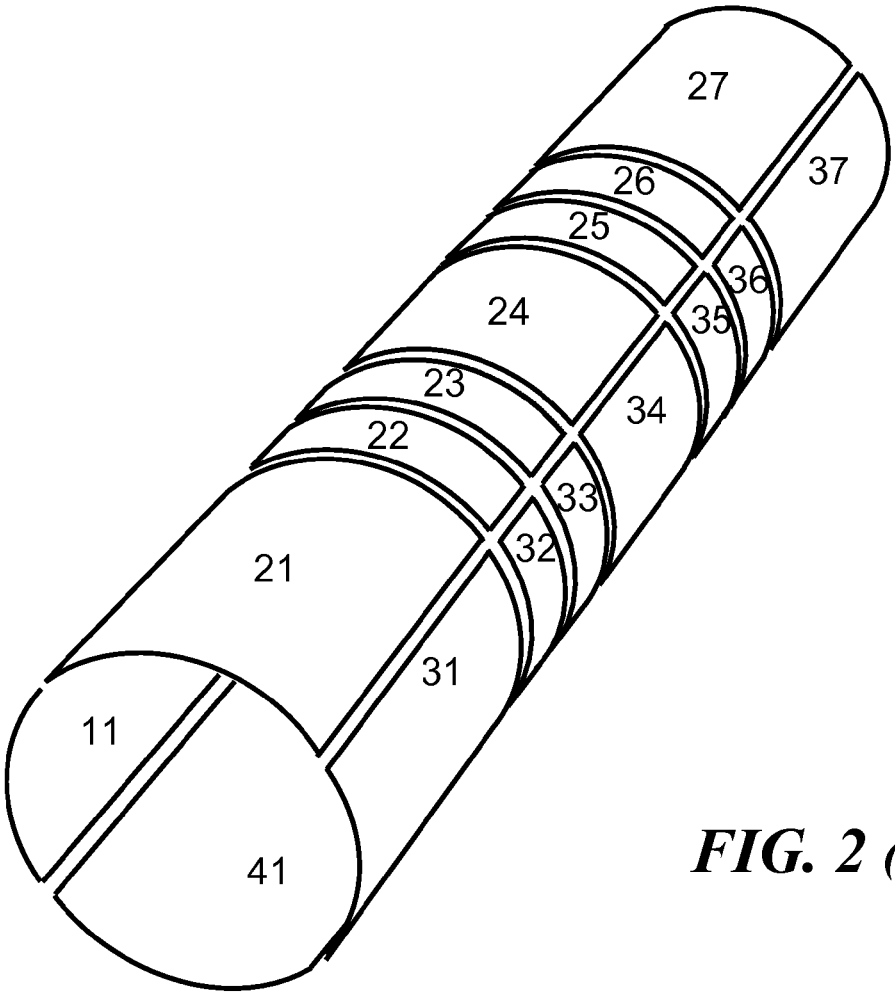
FIG. 2 (Prior Art)
FIG. 2 shows an improved ICR measuring cell, also according to the prior art, with four rows of longitudinal electrodes (11-17), (21-27), (31-37) and (41-47), not all of which are visible. The longitudinal electrodes are each divided into seven segments in order to generate a more advantageous trapping potential. ICR measuring cells of this type can be used to generate the long transients shown in FIGS. 3 and 6.

FIG. 2 shows an improved ICR measuring cell whose four longitudinal electrodes are each subdivided into seven segments. The central segment (24, 34) contains the ion clouds; the electrodes of the terminal segments (21, 31) and (27, 37) carry the trapping potentials. The electrodes of the segments between the central segment and the terminal segments are compensation electrodes; the measuring cell of FIG. 2 has two segments comprising compensation electrodes on each side of the central segment. The potentials of the compensation electrodes can be set so that a long transient can be measured, which results in a high resolution if the formation of a strong beat does not prevent this resolution again. Of the four rows of longitudinal electrodes of the ICR measuring cells, two rows of opposing electrodes are generally used to lift the ions, collected in a thin cloud, to broad cyclotron trajectories by electric excitation. Some or all of the electrodes of the other two opposing rows of electrodes are used for the measurement of the image currents.

For maximum resolution, ICR mass spectrometers are always operated in a so-called "narrowband mode", which measures only a small section of a full mass spectrum at any one time, as is familiar to those skilled in the art. All commercial ICR mass spectrometers offer this narrowband mode in addition to a broadband mode, thus making it possible to measure mass spectra over varying mass ranges. Transients with beats predominantly occur when acquiring narrowband spectra.

The sync pulses which are sometimes used instead of the chirps lift the ion clouds of different masses synchronously into their orbit. In this case, a beat is always initially produced until the ions have spread out and distributed themselves statistically over the orbit. If one wants to achieve the same effect with a sync pulse as with a nonlinear chirp, one has to depart from the basic idea of a sync pulse and temporally distribute the frequencies nonlinearly within the sync pulse. If one pursues this idea logically, one ends up with a nonlinear chirp.

All measurements described below were conducted in a magnetic field of a mere seven tesla; in currently available superconducting magnets with a magnetic flux density of 11 and 15 tesla, correspondingly higher mass resolutions could be achieved.

FIG. 3 shows a transient formed without beats in typical roughly exponentially decreasing form and with a very long useful length. It stems from a measurement of a small mass range about the doubly charged ions of "substance P" ($C_{63}H_{100}N_{18}O_{13}S$). If such a transient is obtained, a nonlinear chirp according to this invention does not need to be used, although it would not do any harm either.

FIG. 4*a* shows the narrowband mass spectrum which was derived from the transient of FIG. 3. The mass spectrum shows not only the signal of the doubly charged monoisotopic ions of mass m/z=674.37135 u but also the first (m/z=674.87303 u) and second $^{13}C$ satellite (m/z=675.37470 u). The mass resolution is R=2,500,000. In mass spectrometry, "monoisotopic ions" means those ions that are composed of only the main isotopes of the elements, i.e. only $^{1}H$, $^{12}C$, $^{14}N$, $^{16}O$, $^{31}P$, $^{32}S$ or $^{35}Cl$.

FIG. 4*b* is an enlarged section of FIG. 4*a*, and shows the fine structure of the second $^{13}C$ satellite. The fine structure is produced because, in this case, not only the signal of the ions which have two $^{13}C$ atoms instead of two $^{12}C$ atoms is present, but also the signals of the ions with $^{18}O$ instead of $^{16}O$, $^{34}S$ instead of $^{32}S$, $^{13}C^{15}N$ instead of $^{12}C^{14}N$, $^{13}C^{2}D$ instead of $^{12}C^{1}H$, etc. For unknown substances, the measurement of such a fine structure makes it easy to determine the elements present, which are very difficult to determine by other means.

Figure 5:
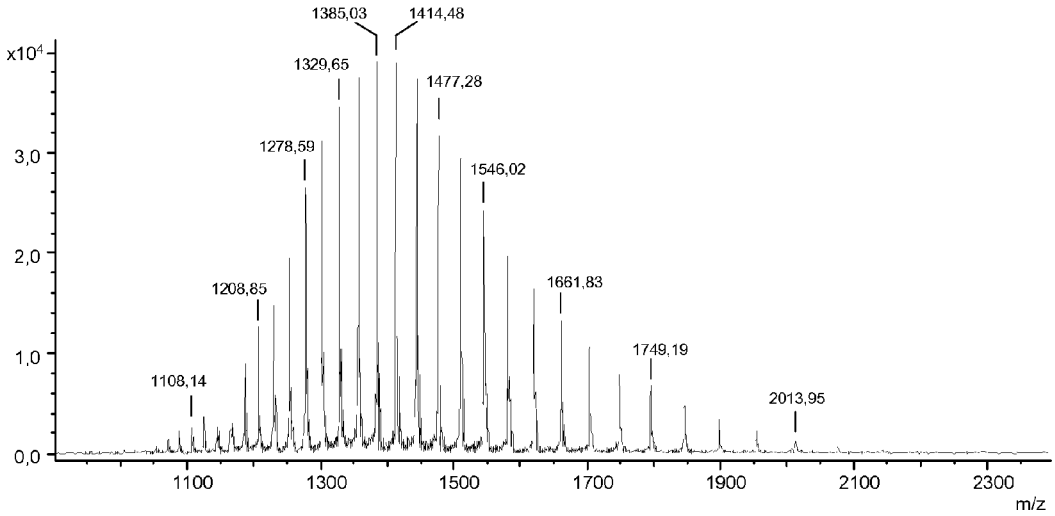
FIG. 5 (Prior Art)
FIG. 5 shows a broadband mass spectrum of BSA (bovine serum albumin) with molecular weight M=66,432.45558 u, in preparation for acquiring mass spectra of an isotopic group with maximum resolution.

For those substances with a very much higher mass in the order of several ten thousand atomic mass units, it is usual to follow a broadband acquisition of an overview spectrum with a further acquisition of a narrowband mass spectrum which only shows the ions of one charge state at maximum resolution. A broadband mass spectrum of BSA is shown in FIG. 5.

For heavy molecules, the ions of one charge state form an isotope group with often far more than a hundred isotope satellites. The problem with the beats occurs in this case. Since the ions of this isotope group each differ by one atomic mass unit (to be more precise: by the mass difference between $^{12}C$ and $^{13}C$ in each case), they constitute a mixture of many ions with the same mass differences, which, in a narrowband measurement, forms a transient consisting of a series of individual "beats", as can be seen in FIG. 6.

The formation of these beats impairs the resolution of the mass spectrum derived from it because the beats require a very high dynamic measuring range for the measurement of the image currents. The beats exceed the transient itself in the spaces by a factor of 100 or more. The measurements of the image currents of normal transients require a measuring range of about $1:10^6$; the occurrence of beats means that a measuring range of $1:10^8$ would be required. This measuring range can hardly be provided by the electronics, and so the prior art overcomes this problem by using a very high number of repeat measurements. Hundreds of image current measurements are performed and added together, but this requires exceedingly long measuring times.

Figure 6:
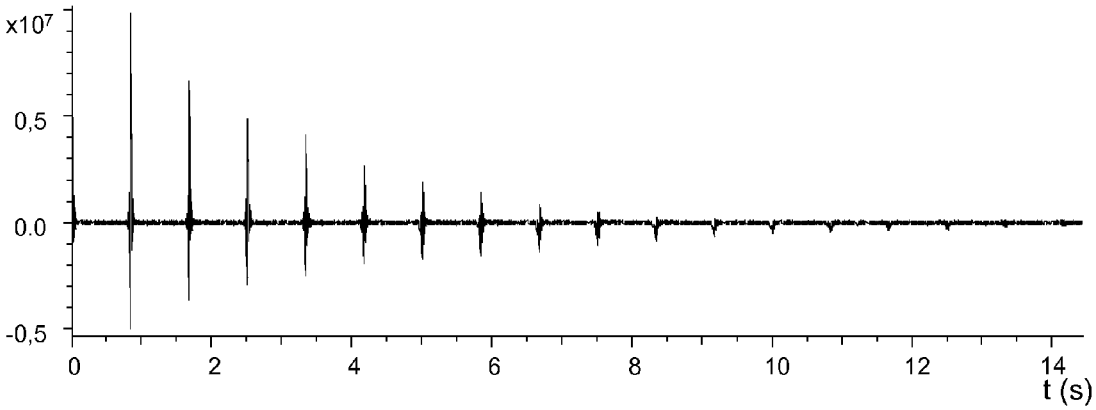
FIG. 6 (Prior Art)
FIG. 6 shows the fundamentally interfering beats in a transient, as were obtained for the measurement of the image currents of the isotopic group of the BSA ions with 49 charges.
Figure 7A:
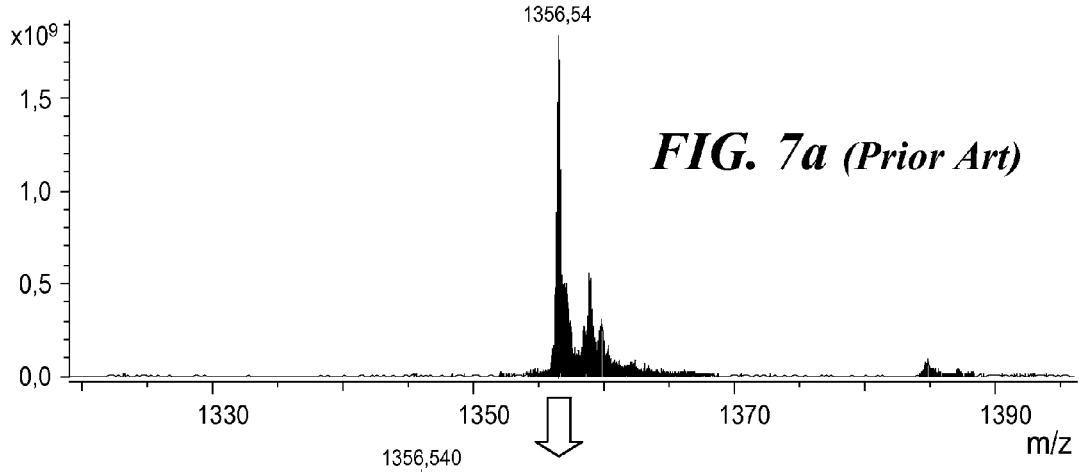
FIG. 7a (Prior Art)
FIG. 7*a* shows the narrowband mass spectrum with the complete isotopic group of the ions with 49 charges; below it, in FIG. 7*b*, is an enlargement of a central section, which extends over only two atomic mass units, and below this, in FIG. 7*c*, a further enlarged section, which extends over only 0.030 atomic mass units, but still contains 15 ion signals of the individual isotope satellites. The mass resolution amounts to R=800,000. It was only possible to acquire such good mass spectra because, in this case, 200 individual measurements of the transient in FIG. 6 were summed, which took a total measuring time of 50 minutes. All the measurements were made in a magnetic field of seven tesla. The mass spectrum of BSA shown here is not calibrated for exact masses, and does therefore deviate from the true values.
Figure 7B:
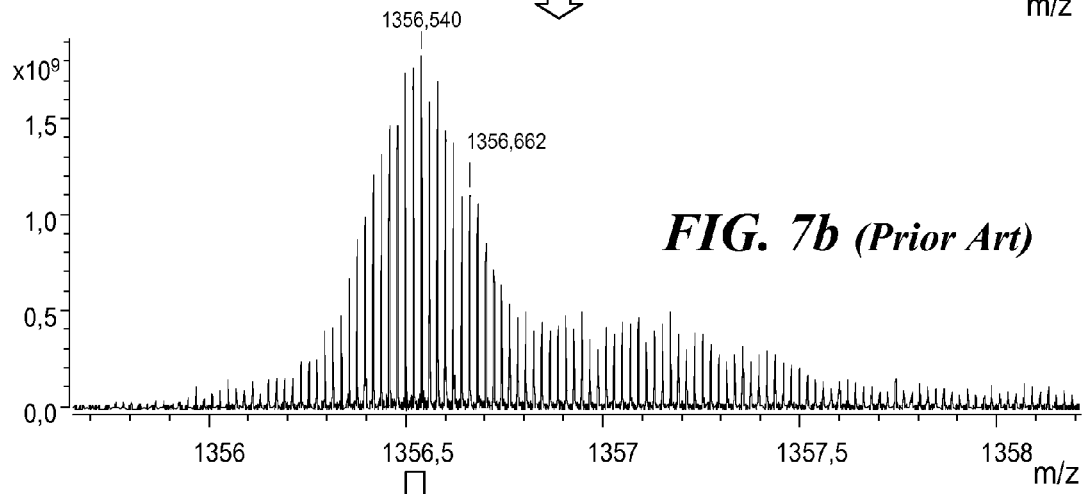
FIG. 7b (Prior Art)
Figure 7C:
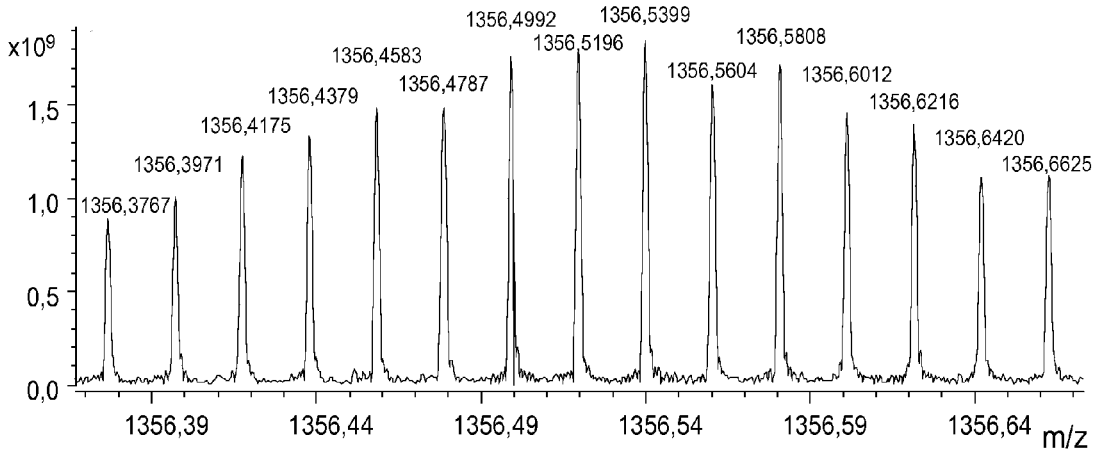
FIG. 7c (Prior Art)
Figure 8:
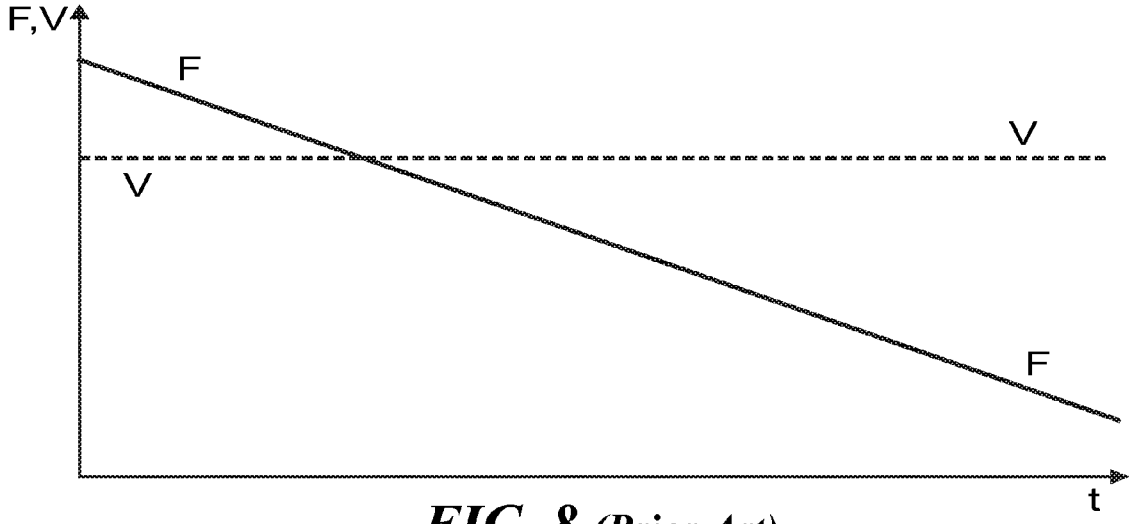
FIG. 8 (Prior Art)
FIG. 8 shows the linear frequency function (F) and amplitude function (V) of a chirp according to the prior art.

In FIGS. 7*b*, 7*c* and 7*d* it can be shown that despite the occurrence of beats in the transient of FIG. 6, a mass spectrum of the isotope signals of the BSA ions (bovine serum albumin; molecular mass M=66 432.455 58 u) with 49 charges can be measured with a mass resolution of R=800,000 if 200 individual spectra are summed. The information can therefore be extracted if the dynamic measuring range can be adapted by special means. In this case, the dynamic measuring range was increased by the summation of 200 transients; the invention, in contrast, reduces the required measuring range by suppressing the beats.

It should be noted here that a successful summation of 200 individual transients requires the electronics to have an unusually high degree of stability, which is rarely the case. Furthermore, a long measuring time of about one hour is required, which is not available for analyses in routine laboratories.

From mass spectra of the type shown in FIGS. 7*a*, 7*b* and 7*c* it is possible to determine whether it is a single substance of high molecular weight or a mixture. Such substances of high molecular weight are often not pure, but also contain oxidized or otherwise derivatized molecules in addition to the basic substance, or they are bonded with associated molecules of lower molecular weight. Analyses of this type can be performed from these mass spectra. Their successful measurement is therefore not only of academic interest.

The invention thus offers the advantage of performing measurements of uniformly structured ion mixtures in a significantly shorter time, yet providing mass spectra of the same quality. It is even to be expected that mass spectra with still higher quality, for example better resolution and higher mass accuracy, can be measured. The use of nonlinear chirps does not have to be restricted to uniformly structured ion mixtures, but can be used for all types of spectral acquisitions, effectively as the basic setting.

What is claimed is:

1. A method for the excitation of ions in an ICR measuring cell having a plurality of excitation electrodes comprising:

(a) placing the ICR measuring cell within a homogeneous magnetic field causing ions therein to move in cyclotron orbits;

(b) applying an alternating current excitation signal having a frequency that varies with time to the electrodes, wherein the frequency varies as a non-linear function versus time.

2. The method of claim 1, wherein the non-linear function is one of a quadratic function, a root function, a higher power function, an exponential function and a logarithmic function.

3. The method of claim 1, wherein the alternating current excitation signal has an amplitude that varies as a function of time.

4. The method of claim 3, wherein the excitation signal amplitudes varies in proportion to the first derivative of the excitation signal frequency as a function of time.

5. A method of operating an ICR measuring cell having a plurality of excitation electrodes and a plurality of detection electrodes, comprising:

(a) placing the ICR measuring cell into a homogeneous magnetic field causing ions therein to move in cyclotron orbits;

(b) introducing ions into the measuring cell;

(c) applying an alternating current excitation signal having a frequency that varies as a non-linear function versus time to the excitation electrodes in order to excite the ions into cyclotron orbits; and (d) detecting ion image currents in the detection electrodes.

6. The method of claim 5, wherein the non-linear function is one of a quadratic function, a root function, a higher power function, an exponential function and a logarithmic function.

7. The method of claim 5, wherein the alternating current excitation signal has an amplitude that varies as a function of time.

8. The method of claim 7, wherein the excitation signal amplitudes varies in proportion to the first derivative of the excitation signal frequency as a function of time.

9. An ICR measuring cell that operates in a homogeneous magnetic field and comprises:

a plurality of excitation electrodes and a plurality of detection electrodes;

an entry port for introducing ions into the measuring cell;

an RF supply that applies an alternating current excitation signal having a frequency that varies as a non-linear function versus time to the excitation electrodes in order to excite the ions in the homogeneous magnetic field into cyclotron orbits; and a detector that detects ion image currents in the detection electrodes.

10. The ICR measuring cell of claim 9, wherein the non-linear function is one of a quadratic function, a root function, a higher power function, an exponential function and a logarithmic function.

11. The ICR measuring cell of claim 9, wherein the alternating current excitation signal has an amplitude that varies as a function of time.

12. The ICR measuring cell of claim 11, wherein the excitation signal amplitudes varies in proportion to the first derivative of the excitation signal frequency as a function of time.

* * * * *